United States Patent [19]

Brown et al.

[11] Patent Number: 4,648,799

[45] Date of Patent: Mar. 10, 1987

[54] COOLED COMBUSTION TURBINE BLADE WITH RETROFIT BLADE SEAL

[75] Inventors: David L. Brown, Medfield, Mass.; Leroy D. McLaurin, Springfield, Pa.

[73] Assignee: Westinghouse Electric Corp., Pittsburgh, Pa.

[21] Appl. No.: 647,859

[22] Filed: Sep. 5, 1984

Related U.S. Application Data

[63] Continuation of Ser. No. 550,058, Nov. 8, 1983, abandoned, which is a continuation of Ser. No. 304,760, Sep. 22, 1981, abandoned.

[51] Int. Cl.[4] ..... F01D 5/18; F01D 5/32

[52] U.S. Cl. ..... 416/95; 416/96 R; 416/220 R

[58] Field of Search ..... 416/92, 95, 96 R, 220 R

[56] References Cited

U.S. PATENT DOCUMENTS 3,493,212 2/1970 Scalzo et al. ..... 415/127

3,572,966 3/1971 Borden et al. ..... 416/95

*Primary Examiner*—Robert E. Garrett

*Assistant Examiner*—H. Edward

*Attorney, Agent, or Firm*—E. F. Possessky

[57] ABSTRACT

The invention comprises a retrofit turbine blade cooling apparatus for replacing non-cooled turbine blades in presently existing combustion turbines. The cooling apparatus comprises a turbine blade structured for fluid cooling and a sealing apparatus structured to cooperate with a root portion of the turbine blade and a subadjacent portion of a turbine disc to force cooling fluid into the turbine blade. Use of the cooling apparatus requires no modification or disassembly of the rotor assembly.

4 Claims, 5 Drawing Figures

58

COOLED COMBUSTION TURBINE BLADE WITH RETROFIT BLADE SEAL

This application is a continuation of application Ser. No. 06/550,058, filed Nov. 8, 1983, abandoned, which is a continuation of application Ser. No. 304,760, filed Sept. 22, 1981, abandoned.

BACKGROUND OF THE INVENTION

The present invention relates generally to combustion turbine rotor blades and more particularly to a cooled combustion turbine rotor blade which may be backfitted into a rotor disc originally structured for a non-cooled turbine rotor blade.

It is well established that greater operating efficiency and power output of a combustion turbine may be achieved through higher inlet operating temperatures. Inlet operating temperatures are limited, however, by the maximum temperature tolerable to the rotating turbine blades. Also, as turbine blade temperature increases with increasing inlet gas temperature, the vulnerability of the blades to damage from the tension and stresses which normally accompany blade rotation also increases. Cooling the turbine blades, or forming the blades from a temperature resistant material, or both, permits an increase in inlet operating temperatures while keeping the turbine blade temperature below the maximum specified operating temperature for the blade material.

There are presently many combustion turbines in the field today which have non-cooled turbine rotor blades. In some models the first stage blades are cooled while blades in subsequent stages are not. Generally, those combustion turbines which have non-cooled turbine rotor blades provide some means for cooling the root of the blades, such as the means set forth in U.S. Pat. No. 3,501,249 and U.S. Pat. No. 3,572,966. Cooling the blade root is a simple method for providing partial cooling of the blade airfoil. The latter patent describes a structure whereby cooling air drawn from the compressor is forced through individual channels in each disc to a path between the blade root and the disc. After passing between the blade root and the disc, the cooling air exits into the exhaust path of the hot motive gases driving the turbine.

To improve the operating efficiency and power output of the combustion turbine, it is desirable to provide means which enables a flow of cooling air through the turbine blades themselves so that the blade surfaces are positively cooled to keep the blade surface temperature below the turbine inlet temperature. A prior art approach to this problem is shown in U.S. Pat. No. 3,853,425. This patent describes an assembly for sealing the exhaust end of the cooling path between the blade root and the disc, forcing the cooling air up through the blade root into the airfoil portion of the turbine blade. The cooling air thereafter exits from the airfoil portion into the exhaust path of the hot motive gases. The sealing assembly of the latter patent comprises a seal structure mating with grooves within the blade root and the disc to close the exhaust end of the cooling path between the blade root and the disc. Hence, use of the apparatus described in the latter patent requires special machining of the rotor disc as well as a specially structured turbine blade.

While the sealing assembly described above provides an efficient and effective method for channeling cooling air to the turbine blade, it is not readily adaptable to combustion turbines presently in the field. Application of this structure to field units would require structural modifications to both the turbine blade root and the rotor disc. Modifications to the rotor disc would necessitate removal of the rotor spindle from the lower half of the turbine casing. As explained in U.S. Pat. No. 3,493,212, the positioning of the rotor is highly critical, so that once it is properly located it should remain undisturbed if at all possible. Removal of the rotor spindle also increases the time and expense required to implement changes to the combustion turbine.

Hence, it would be advantageous to develop a cooled combustion turbine blade with sealing structure such that it may be backfitted into presently existing rotor discs, thereby providing the advantages of cooled turbine blades without the disadvantages of rotor spindle removal.

SUMMARY OF THE INVENTION

Accordingly, a combustion turbine rotor blade which has a cooling system and sealing apparatus and is adapted for support on a rotor disc is provided for replacing non-cooled turbine blades in presently existing combustion turbines. The turbine blade, with cooling system and sealing apparatus, operates in cooperation with the rotor disc to effect a blade cooling structure in presently existing discs having non-cooled blades. The cooling system comprises means within a blade airfoil and a blade root for conducting coolant fluid therethrough. The sealing apparatus is structured to affix to the blade root and sealingly close an axially extending chamber formed between the radially innermost portion of the blade root and the rotor disc. The sealing apparatus thereby closes a former exhaust path for coolant fluid and forces the coolant fluid into the turbine blade. Use of the cooled turbine blade requires no modification or disassembly of the turbine rotor assembly.

DESCRIPTION OF THE PREFERRED EMBODIMENT

Increased combustion turbine operating temperatures in presently existing combustion turbines has made it necessary to provide cooled turbine blades where before the blades were not cooled. In accordance with the principles of the invention, a combustion turbine blade with cooling system and sealing apparatus is provided. The blade is adapted for support on and operates in cooperation with prior art turbine rotor discs, providing a blade cooling structure for presently operating turbines having discs with non-cooled blades. The cooled turbine blade comprises a turbine blade specially constructed for conduction of cooling fluid and a sealing apparatus for closing a fluid flow path between the blade root and the disc of the prior art structure and thereby forcing coolant fluid to flow within the modified turbine blade structure.

Figure 1:
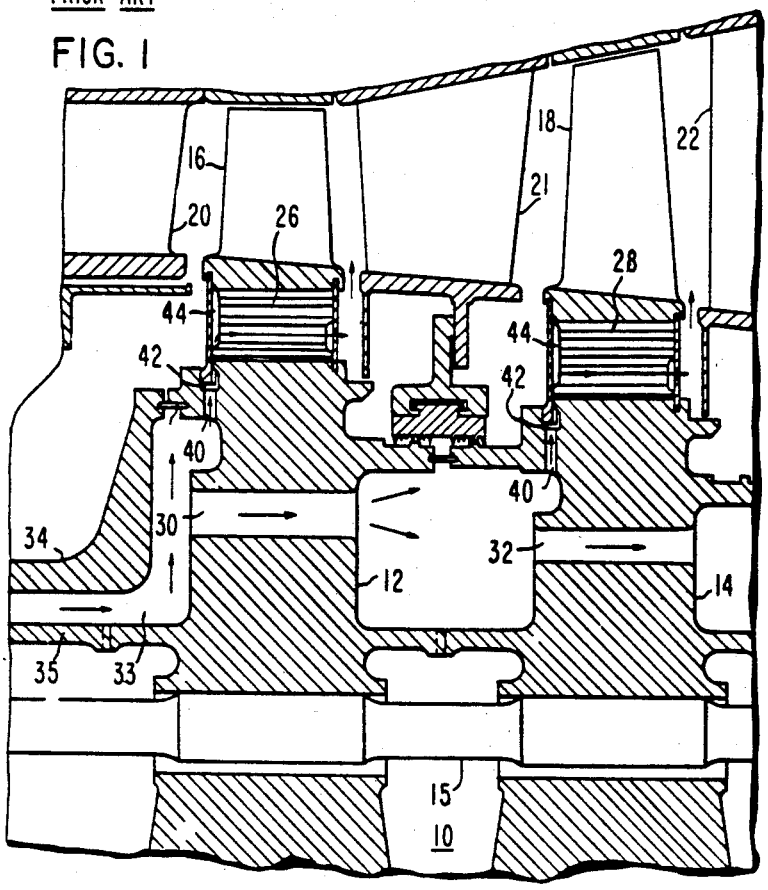
PRIOR ART FIG. 1
FIG. 1 shows a section view of a portion of a typical prior art turbine section of a combustion turbine.

Referring now to the drawings, FIG. 1 shows a portion of a typical prior art rotor 10 for an axial flow turbine in longitudinal section. The rotor 10 may comprise an aggregate of rotor discs only two of which 12, 14 are shown, secured together by circumferentially disposed tie or staybolts 15 extending through the discs, only one tie bolt being shown in FIG. 1.

Figure 5:
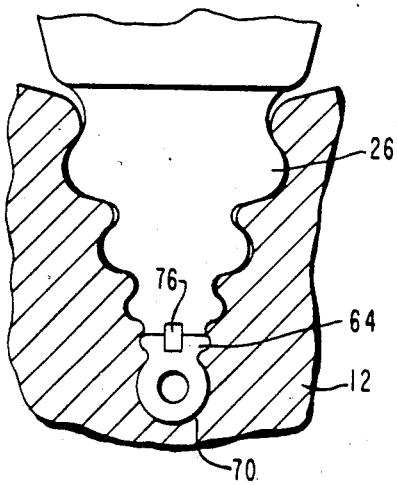
FIG. 5 shows a cutaway of FIG. 2 in section revealing an upstream view of the cooled turbine blade root and sealing apparatus of the invention in position within the turbine disc.

The discs 12, 14 support, respectively, rotor blades 16, 18 extending radially outwardly therefrom, the blades being disposed between axially spaced, inwardly extending fixed stator or nozzle blades 20, 21, 22. The rotor blades are respectively provided with root portions 26, 28 of the side entry type which may be of the serrated of "fur tree" type for disposition in serrated recesses (see FIG. 5) provided in the periphery of the discs.

The rotor discs 12, 14 are further provided respectively with axially extending openings or channels 30, 32. The channels are in fluid communication with a passageway 33 formed by a tubular fairing member 34 disposed in encompassing relation with a center torque tube structure 35.

The discs 12, 14 are provided with circumferentially spaced, radially extending openings 40 on the upstream side and near the periphery thereof. The openings 40 are formed in the disc to be in fluid communication with the passageway 33.

The upstream side of the disc 12, 14 is further provided with an annular, continuous groove or channel 42 facing in a radially outward direction. The groove is formed in fluid communication with the radially extending openings 40. The detail of this typical prior art structure is further described in U.S. Pat. No. 3,572,966.

Figure 2:
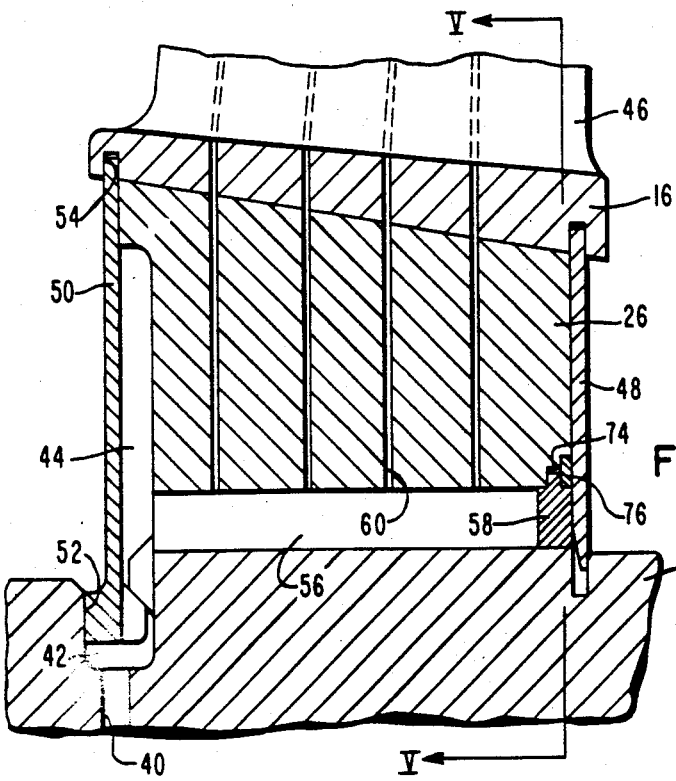
FIG. 2 shows a section view of a portion of a turbine blade with sealing apparatus and cooling system structured according to the principles of the invention.

FIG. 2 shows a portion of the prior art disc 12 with a turbine blade and sealing mechanism structured according to the principles of the invention. For the purposes of the invention, the structure of disc 12 and disc 14 are substantially identical. The turbine blade 16 comprises an airfoil portion 46 and a root portion 26. The root portion of the turbine blade is secured to the disc by the serrated structure of the blade-disc juncture and by conventional sideplates 48, 50, such as those described in U.S. Pat. No. 3,572,966. The annularly disposed upstream sideplates 50, when secured within grooves 52, 54 formed respectively in the disc and blade define a continuous circumferential coolant chamber 44 with the adjacent ends of the roots 26 of the turbine blades. The coolant chamber 44 is structured in fluid communication with the continuous channel 42 and the radial openings 40.

In operation of the rotor a pressurized cooling fluid such as air from a compressor section of the combustion turbine is directed through the passageway 33 to the first disc 12 (see FIG. 1). At the disc 12, the flow of air divides, part of the air traveling through the axial opening 30 in the disc 12 to the second disc 14. The remainder of the air is directed radially outward (upward in FIG. 1 as indicated by the appropriate arrows) to the openings 40 beneath the annular groove 42. From the annular groove 42 the air is then directed into the annular chamber 44 formed by the upstream sideplates and the ends of the blade roots. The flow of air is then directed through the clearances between the blade root and disc recesses and particularly into a plenum chamber 56 formed between the base of the blade root and the turbine disc.

In the typical prior art structure of FIG. 1 the cooling air would pass from the plenum chamber 56 through an aperture in the exhaust sideplate 48 and into the exhaust path of the hot motive gases driving the turbine. In the cooling mechanism of the invention, a sealing apparatus 58, shown in greater detail in FIGS. 3, 4, and 5, closes the exhaust end of the plenum chamber 56, forcing the cooling air into radially extending channels 60 within the turbine blade. The precise arrangement for coolant flow within the root and airfoil portions of the turbine blade is not critical to an understanding of the principles of the invention and may be any of several arrangements well known in the prior art.

Figure 4:
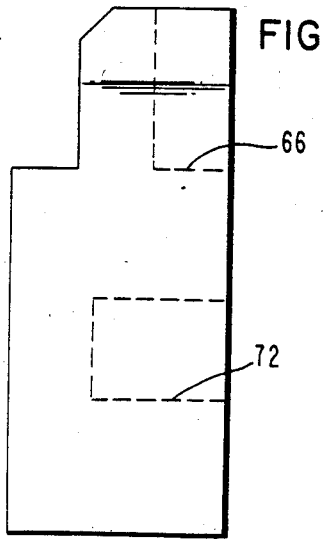
FIG. 4 shows a side view of the sealing apparatus of the invention.
Figure 3:
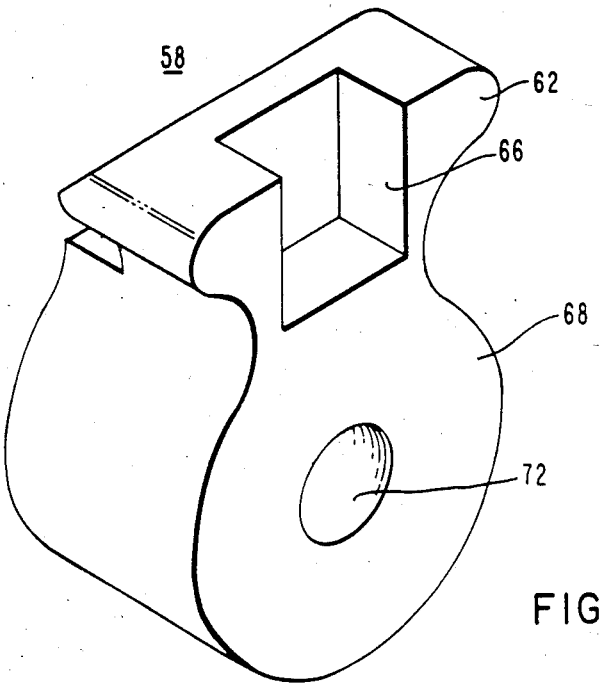
FIG. 3 shows a front perspective view of the sealing apparatus of the invention.

The sealing apparatus 58 is structured so as to require no structural modification of the rotor disc 12 for its implementation. FIG. 3 shows an upstream perspective view of the sealing apparatus 58. FIG. 4 shows a side view of the same sealing apparatus. The upper portion of the sealing apparatus is shaped to fit continuously within the radially innermost serration 64 (FIG. 5) of the root portion of the turbine blade. The upper portion 62 of the sealing apparatus also defines a rectangular notch 66 which permits fixed engagement of the sealing apparatus within the root of the turbine blade.

A lower portion 68 of the sealing apparatus 58 is shaped to fit closely the periphery 70 (FIG. 5) of the plenum chamber 56 so as to seal the downstream end of that chamber. The thickness of the lower portion should be sufficient to assure adequate sealing of the plenum chamber but should preferably be no greater than the radial dimension of the lower portion. A recess 72 of any convenient configuration is provided in the lower portion of the sealing apparatus in the face which is adjacent the exhaust sideplate 48. The recess 72 simplifies assembly and disassembly of the sealing apparatus within the blade root and plenum chamber.

The exhaust end of the bottom serration of the blade root is notched as shown in FIG. 2 at 74 to permit the upper portion 62 of the sealing apparatus to fit closely within the disc serration. A blade tab 76 integral with the blade root mates with the rectangular notch 66 in the upper portion of the sealing apparatus, restricting movement of the sealing apparatus in the axial direction. The close fitting shape of the sealing apparatus within the disc serration and plenum chamber restricts movement of the sealing apparatus in the radial direction.

Thus, the combination of a cooled turbine blade and a sealing apparatus, cooperating according to the principles of the invention, provides a simple and yet effective structure which may be backfitted into presently existing combustion turbines having non-cooled blades. The turbine blade and its cooling mechanism set forth herein permit replacement of non-cooled turbine blades with cooled turbine blades without structural modification or disturbance of the turbine rotor.

What is claimed is:

1. A cooled turbine blade assembly adapted for installation on a rotor disc (1) having axially extending serrated slots provided about the disc periphery to receive serrated blade root portions in mating engagement; and (2) having means for providing a flow of cooling air through a plenum chamber in each blade root slot between each blade root and the disc;

said blade assembly comprising a blade having an airfoil portion and a root portion engageable with the disc in one of the slots and means for conducting cooling fluid from the plenum chamber beneath the root portion through the root portion and the airfoil portion and into an exhaust path to the motive axial fluid surrounding the airfoil portion;

a separate sealing member having an upper portion thereof engaged against a side portion of said blade root portion to prevent sealing member axial movement and a lower portion thereof disposed in and contoured closely with the associated serrated disc slot to close off the plenum chamber on the blade downstream side;

said upper portion being shaped to fit closely within a notched corner of a radially innermost serration of the blade root, so that the upper portion of said sealing member is generally continuous with the blade root;

said lower portion being shaped in the radial plane to closely fit and fill the space between the walls of the plenum chamber and dimensioned in the axial plane to a thickness which is less than the radial dimension of the lower portion; and side plate means engaged against said blade and said sealing member to lock the same in place.

2. An apparatus according to claim 1 wherein the upper portion of said sealing member is notched along both radial plane surfaces to mate with corresponding grooves in the blade root so as to stabilize the sealing member in the axial direction.

3. An apparatus according to claim 2 wherein said apparatus includes a mating tab integral with the blade root and interlocking with a corresponding notch in the radial plane surface of said sealing member facing away from the plenum chamber.

4. An apparatus according to claim 1 wherein the lower portion of said sealing member defines a recess extending from the radial plane surface facing away from the plenum chamber in the axial direction, the recess aiding in assembly and disassembly of said sealing member.

* * * * *